US005785111A

United States Patent [19]

Noguchi et al.

[11] Patent Number: 5,785,111

[45] Date of Patent: Jul. 28, 1998

[54] BLOW-SQUEEZE MOLDING MACHINE

[75] Inventors: Masahide Noguchi, Toyohashi; Kazuo Kotaka, Toyokawa, both of Japan

[73] Assignee: Sintokogio, Ltd., Nagoya, Japan

[21] Appl. No.: 758,742

[22] Filed: Dec. 6, 1996

[30] Foreign Application Priority Data

Dec. 15, 1995 [JP] Japan ..... 7-348092

[51] Int. Cl.[6] ..... B22C 15/24

[52] U.S. Cl. ..... 164/200; 164/201; 164/202

[58] Field of Search ..... 164/200, 201, 164/202

[56] References Cited

U.S. PATENT DOCUMENTS

| | | | |
|---|---|---|---|
| 4,750,540 | 6/1988 | Boenisch | 164/38 |
| 5,125,449 | 6/1992 | Asao | 164/195 |
| 5,148,851 | 9/1992 | Murata | 164/20 |
| 5,597,029 | 1/1997 | Landua | 164/200 |

FOREIGN PATENT DOCUMENTS 2-14833 4/1990 Japan .

5-337605 12/1993 Japan .

*Primary Examiner*—Patrick Ryan
*Assistant Examiner*—Ivrie A. Schwartz
*Attorney, Agent, or Firm*—Limbach & Limbach L.L.P.

[57] ABSTRACT

An apparatus for precisely and adequately filling each of upper and lower flask bodies with molding sand equipped with upper and lower compressed air jet mechanisms (which fluidize molding sand at side and lower parts in a substantially horizontal part of each of upper and lower blow heads) and upper and lower guide members (which guide molding sand so as to disperse it toward the entire area of end openings of the blow heads after the molding sand in each blow head has first been focused on the blow head's central part) projectingly provided in the upper and lower blow heads, and a blow head for use in such an apparatus. Thus, the molding sand in the upper and lower blow heads is almost entirely fluidized by jetting compressed air from the upper and lower jet mechanisms when molding sand is blow-squeezed into upper and lower flask bodies. As a result, the molding sand is blown into the upper and lower flask bodies while it is dispersed toward the entire area of the end openings of the upper and lower blow heads.

2 Claims, 2 Drawing Sheets

BLOW-SQUEEZE MOLDING MACHINE

TECHNICAL FIELD OF THE INVENTION

This invention relates to improvements in a blow-squeeze molding machine.

BACKGROUND OF THE INVENTION

As disclosed in Japanese Utility Model Publication No. 2-14833, one type of molding machine comprises a match plate, upper and lower flask bodies, each of which is disposed so that it can respectively abut upper and lower surfaces of the match plate, upper and lower elevating blow heads which can blow-squeeze molding sand into the upper and lower flask bodies abutting the match plate, and a sand magazine which can blow molding sand into the upper and lower blow heads.

However, in such a molding machine, molding sand is fed from one sand magazine into both the upper and lower blow heads. The upper and lower heads in turn simultaneously blow the molding sand into the upper and lower flask bodies, respectively. Thus, it is very difficult to precisely and adequately fill each of the upper and lower flask bodies with molding sand. Hence, as hitherto disclosed in Japanese Patent Early-publication No. 5-337605, a proposal for improving such a molding machine has been made wherein mechanisms for jetting compressed air to change the direction of advancing molding sand within the blow heads are provided in the upper and lower blow heads respectively. However, such an improved molding machine still has drawbacks in that neither the upper nor lower flask body can be precisely filled with molding sand.

The present invention was made considering the above-mentioned problem. The purpose of this invention is to provide a blow-squeeze molding machine equipped with mechanisms that can precisely and adequately fill each of upper and lower flask bodies with molding sand.

SUMMARY OF THE INVENTION

To achieve the above-mentioned purpose, the blow-squeeze molding machine of this invention comprises a match plate, upper and lower flask bodies, which are each disposed so as to be able to respectively abut upper and lower surfaces of the match plate, upper and lower blow heads disposed movably up and down for blow-squeeze molding sand into the upper and lower flask bodies abutting the match plate, a sand magazine for blowing molding sand into the upper and lower blow heads, first upper and lower jet mechanisms respectively provided in the upper and lower blow heads for jetting compressed air to change the direction of the advancing molding sand so that the molding sand can simultaneously be blow-squeezed into the upper and lower flask bodies abutting the match plate, second upper and lower jet mechanisms respectively provided in the upper and lower blow heads for jetting compressed air so as to fluidize molding sand both at side and lower parts in the horizontal parts of the upper and lower blow heads, and upper and lower guide members projectingly provided respectively in the upper and lower blow heads for guiding the molding sand within the upper and lower blow heads such that the molding sand is dispersed towards the entire area of their tip openings after the sand has once been focused on a central part in the upper and lower blow heads.

The blow head used in the present invention for blow-squeezing molding sand into a flask body comprises a first jet mechanism for jetting compressed air to change the direction of the advancing molding sand, a second jet mechanism for jetting compressed air to fluidize the molding sand both at side and lower parts in the blow head, and a guide member for guiding the molding sand within the blow head to disperse the sand towards the entire area of the tip opening thereof after the sand has first been focused on a central part in the blow head.

DETAILED DESCRIPTION

Figure 1:
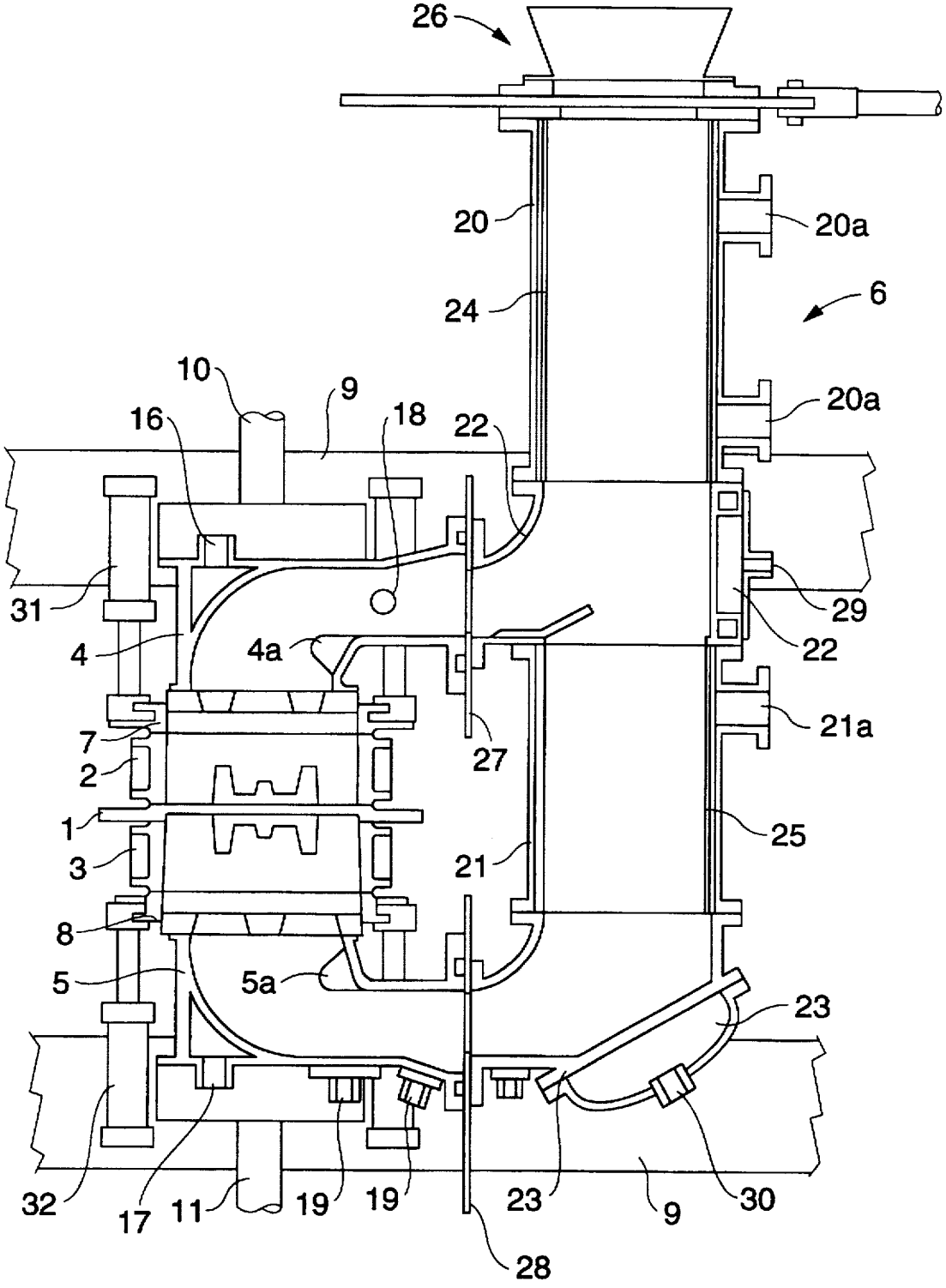
FIG. 1 is a section showing one embodiment of this invention.

An embodiment of this invention will now be explained in detail by reference to FIG. 1. The blow-squeeze mold molding machine of this invention comprises a match plate 1, upper and lower flask bodies 2,3, each of which can respectively abut the upper and lower surfaces of the match plate 1, upper and lower elbow-shaped blow heads 4,5, disposed movably up and down for blow-squeezing molding sand into the upper and lower flask bodies 2,3 abutting the match plate 1, a sand magazine 6 (from which molding sand can be blown into the upper and lower blow heads 4,5), and upper and lower filling frames 7,8 disposed movably up and down between the upper and lower flask bodies 2,3 and the upper and lower blow heads 4,5.

The upper and lower flask bodies 2,3 can be moved up and down by cylinders (not shown). The upper and lower blow heads 4,5 are mounted on the ends of the piston rods of cylinders 10,11 mounted on a frame 9 so that they can be moved up and down by the expansion/contraction movement of the cylinders 10,11. As shown in FIG. 1, each of upper and lower blow heads 4,5 has an outlet end, a hollow passage through which molding sand can advance to the outlet end, and arcuate inner and outer wall bend portions near the outlet end. The upper and lower blow heads 4,5 are equipped with first upper and lower jet mechanisms for jetting compressed air to change the direction of molding sand advancing within the blow heads 4,5 to direct the molding sand toward the upper and lower flask bodies 2,3; second upper and lower jet mechanisms for jetting compressed air to fluidize molding sand at the side and lower parts in the substantially horizontal part of the upper and lower blow heads 4,5; and upper and lower guide members *4a,5a* for guiding molding sand within the upper and lower blow heads 4,5 such that the molding sand is dispersed towards the entire area of their tip openings after it has first been focused on a central part in the upper and lower blow heads 4,5.

Figure 2:
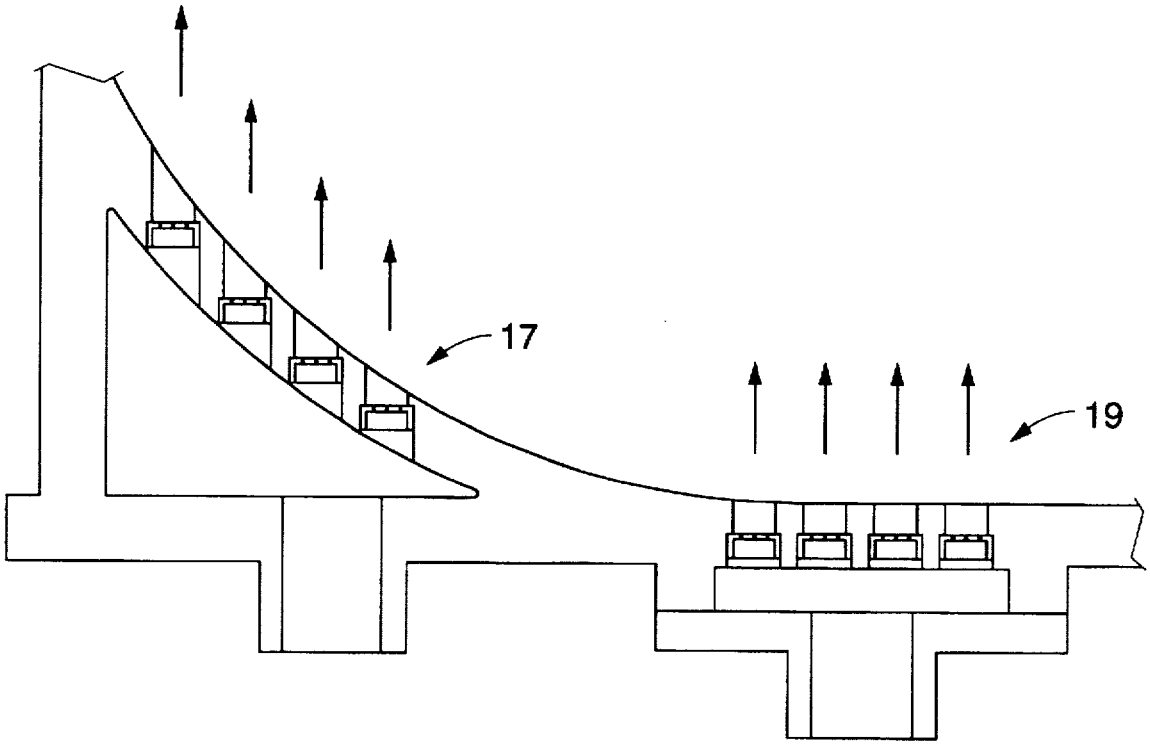
FIG. 2 is an enlarged section showing part of the embodiment of FIG. 1 in detail.

The first upper and lower compressed air jet mechanisms are constituted by first upper and lower nozzles 16,17 (which respectively pass through the bending parts of the upper and lower blow heads 4,5, and which are provided with wire netting at their ends) and a source of compressed air (not shown) communicating with the first upper and lower nozzles 16,17. The second upper and lower compressed air jet mechanisms are constituted by second upper and lower nozzles 18,19 (which respectively pass through the side and lower parts of the substantially horizontal parts of the upper and lower blow heads 4,5, and which are provided with wire netting at their ends) and a source of compressed air (not shown) communicating with the second upper and lower nozzles 18,19. An example of a detailed arrangement of the first and second lower nozzles 17, 19 is shown in FIG. 2. The arrows in FIG. 2 show the directions of air jetted through the nozzles.

Above-mentioned sand magazine 6 is structured such is that upper and lower bending cylindrical bodies 22,23, which can be made to respectively communicate with openings at the base ends of the upper and lower blow heads 4,5, are provided at the lower ends of upper and lower cylindrical storage tanks 20,21. 20 Tanks 20,21 have compressed air supply openings 20*a*,21*a* communicating with a source of compressed air (not shown). Upper and lower cylindrical bodies 24,25, with slits penetrating therethrough, are provided inside the upper and lower cylindrical storage tanks 20,21. A first slide gate mechanism 26 is provided at the upper end of the upper storage tank 20; second upper and lower slide gate mechanisms 27,28 are respectively provided between the upper and lower blow heads 4,5 and the upper and lower bending cylindrical bodies 22,23; upper and lower compressed air supply mechanisms 29,30, which supply compressed air toward the tip openings thereof, are respectively provided in the upper and lower bending cylindrical bodies 22,23; and upper and lower filling frames 7,8 are respectively mounted on the ends of the piston rods of the second upper and lower cylinders 31,32 mounted on the frame 9.

Sand magazine 6 is operated such that a given amount of molding sand is fed into the upper and lower sand storage tanks 20,21; the molding sand inside the upper and lower blow heads 4,5 is blow-squeezed respectively into the upper and lower flask bodies 2,3 and the upper and lower filling frames 7,8 by supplying compressed air to the sand magazine 6 and by causing the upper and lower heads 4,5 to come near each other. At the same time as the blow-squeeze operation occurs, compressed air is jetted from the first and second nozzles 16–19 of the second upper and lower compressed air jet mechanisms. As a result, the molding sand, which has respectively flowed into upper and lower blow heads 4,5 from the upper and lower sand storage tanks 20,21, flows steadily while being almost entirely fluidized by the compressed air jetted from the first and second upper and lower nozzles 16–19, is dispersed into the entire area of the tip openings of blow heads 4,5 (after being focused on the central parts by the guide members 4*a*,5*a*), and then respectively blow-squeezed from the tip openings of the blow heads 4,5 into spaces defined by the upper and lower flask bodies 2,3 and the upper and lower filling frames 7,8. Thus, after the blow-squeezing operation has been completed, nonframe-shaped upper and lower molds can be formed by performing the usual post-blow-squeezing operations that are performed by the kind of molding machine described with reference to FIG. 1.

As is clear from the above description, since the second upper and lower compressed air jet mechanisms (which fluidize molding sand at side and lower parts in the substantially horizontal parts of the upper and lower blow heads) are respectively provided in the upper and lower blow heads, and since the upper and lower guide members (which guide molding sand so as to disperse it toward the entire area of the tip openings after the molding sand in the blow heads is first focused on its central part) are projectingly provided in the upper and lower blow heads, molding sand in the upper and lower blow heads can be almost entirely fluidized, and blown into the upper and lower flask bodies while being dispersed toward the entire area of the tip openings of the blow heads. Hence, operation of the invention causes each of the upper and lower flask bodies to be precisely and adequately filled with molding sand.

What is claimed is:

1. A blow-squeeze machine equipped with a match plate, upper and lower flask bodies which are each disposed so as to be able to respectively abut upper and lower surfaces of the match plate, upper and lower blow heads disposed movably up and down for blow-squeezing molding sand into the upper and lower flask bodies abutting the match plate, said upper and lower blow heads having horizontal parts and outlet ends, a sand magazine which includes at least one compressed air supply mechanism which blows molding sand into the upper and lower blow heads, and first upper and lower jet mechanisms respectively provided at first positions in the upper and lower blow heads for jetting compressed air to change the direction of the advancing molding sand so that the molding sand can simultaneously be blow-squeezed into the upper and lower flask bodies abutting the match plate, wherein:

the upper and lower blow heads respectively include hollow passages having respectively arcuate inner and outer wall bend portions near each of the outlet ends, wherein the wall bend portions are configured to respectively direct the molding sand to the upper and lower flask bodies;

second upper and lower jet mechanisms respectively provided in the upper and lower blow heads in second positions for jetting compressed air so as to fluidize the molding sand both at side and lower parts in the horizontal parts of the upper and lower blow heads; and upper and lower guide members projectingly provided respectively in the inner wall bend portions of the upper and lower blow heads in positions for guiding the molding sand within the upper and lower blow heads such that combined action of the compressed air from the first upper and lower jet mechanisms and the second upper and lower jet mechanisms on the molding sand advancing through the hollow passages causes said molding sand to be dispersed towards the entire area of the outlet ends.

2. A blow head used for blow-squeezing molding sand into a flask, said blow head comprising:

a hollow passage having an outlet end and having arcuate inner and outer wall bend portions near the outlet end, wherein the wall bend portions are configured to direct the molding sand advancing through the hollow passage to the flask;

a first jet mechanism positioned along the hollow passage for jetting compressed air so as to change the direction of the molding sand advancing through the hollow passage;

a second jet mechanism positioned alone the hollow passage for jetting compressed air so as to fluidize the advancing molding sand both at side and lower parts in the blow head, and a guide member positioned in the inner wall bend portion for guiding the molding sand so that combined action of the compressed air from the first jet mechanism and the second jet mechanism on the molding sand advancing through the hollow passage causes said molding sand to be dispersed towards the entire area of the outlet end.

* * * * *